US006237484B1

(12) United States Patent
Homma et al.

(10) Patent No.: US 6,237,484 B1
(45) Date of Patent: May 29, 2001

(54) SCREEN PRINTING APPARATUS

(75) Inventors: Makoto Homma, Sawara; Mitsuhiko Sato, Kashiwa; Isao Abe, Sawara; Noriaki Mukai, Toride, all of (JP)

(73) Assignee: Hitachi Techno Engineering Co., Ltd., Tokyo (JP)

( * ) Notice: Subject to any disclaimer, the term of this patent is extended or adjusted under 35 U.S.C. 154(b) by 0 days.

(21) Appl. No.: 09/199,169

(22) Filed: Nov. 25, 1998

(30) Foreign Application Priority Data

Nov. 28, 1997 (JP) ..... 9-328200

(51) Int. Cl.[7] ..... B41F 35/00; B41L 41/00
(52) U.S. Cl. ..... 101/114; 101/425
(58) Field of Search ..... 101/114, 123, 101/129, 423, 425

(56) References Cited

U.S. PATENT DOCUMENTS 3,771,450 * 11/1973 Cleybergh ..... 101/425
4,911,074 * 3/1990 Simila ..... 101/114
4,953,252 * 9/1990 Akisawa ..... 101/425
5,197,384 * 3/1993 Yawata et al. ..... 101/114
5,491,871 * 2/1996 Reber et al. ..... 15/308
5,784,963 * 7/1998 Schmid ..... 101/425
5,865,117 * 2/1999 Asai et al. ..... 101/425
5,901,405 * 5/1999 Tani ..... 101/425
6,016,750 * 1/2000 Nussel et al. ..... 101/425

* cited by examiner

*Primary Examiner*—Stephen R. Funk
(74) *Attorney, Agent, or Firm*—Antonelli, Terry, Stout & Kraus, LLP

(57) ABSTRACT

A screen printing apparatus 199, 169 has a roll paper vibrating device which vibrates roll paper in contact with the lower surface of a screen mask in a direction perpendicular to a moving direction of the roll paper while the roll paper is being moved in contact with the lower surface of the screen mask. Thereby, the roll paper in contact with the lower surface of the screen mask is moved in a waveform-shape pattern. Therefore, the cumulative contact area of the roll paper on the lower surface of the mask is increased, and it is possible to efficiently remove residue, such as paste attached onto the lower surface of the screen mask of the printing apparatus and paste attached inside pattern openings of the screen mask, to maintain a good printing performance.

11 Claims, 16 Drawing Sheets

SCREEN PRINTING APPARATUS

BACKGROUND OF THE INVENTION

The present invention relates to a screen printing apparatus and, more particularly, to a screen printing apparatus which has a roller carrying cleaning paper for removing residue, such as paste, attached on a surface of a screen mask and paste attached inside openings of the mask pattern, using the cleaning paper.

When film (pattern) forming is repetitively carried out on substrates by screen printing, paste begins to remain on the side of the mask surface which is in contact with the substrate or within the openings in the mask. Thereby, a blur or dimness gradually appears in the pattern printed on the substrate, which causes a pattern short-circuit or a pattern line-break. Therefore, it is necessary to perform a cleaning operation for removing the attached paste residue (mask cleaning) by cleaning the mask which has been used for a certain number of printings.

For such mask cleaning, for example, Japanese Patent Application Laid-Open No. 63-59535 proposes a cleaning apparatus for a printing machine in which a cleaning roller is arranged in contact with the lower surface of a printing plate, and the cleaning roller is vibrated in the direction of its shaft using compressed air or the like to wipe off ink attached onto the lower surface of the printing plate. Japanese Patent Application Laid-Open No. 5-229108 proposes a cleaning apparatus for a printing machine which operates to wipe the lower side of a mask using a roll cloth in combination with a suction nozzle.

Since the openings of a pattern or the amount of clearance between patterns has been getting smaller in recent high-definition masks, problems occur as described below.

In the vibration cleaning roller method described above, if residue transferred onto the roller surface is not removed from the roller when the apparatus is operated without human intervention for a long time, the residue may be retransferred onto the mask during the continuous operation. Therefore, it is necessary for the cleaning roller to be provided with an adhesive force by increasing the friction coefficient of the cleaning roller surface. However, the cleaning roller cannot be vibrated at a high speed if the cleaning roller surface is provided with a large friction coefficient, and, accordingly, the residue attached on the inside of openings cannot be completely removed in a high-definition mask.

On the other hand, in the method which uses a roll cloth in combination with a suction nozzle, the cleaning apparatus can be operated without human intervention for a long time because the mask is cleaned continuously with a new cloth. However, there occurs a problem in that, since the winding direction of the roll cloth is unidirectional in order to perform cleaning always with a new cloth surface, residue tends to remain on the edge of the narrow opening portion of the mask pattern, particularly on the winding direction side, and so the residue cannot be completely removed.

SUMMARY OF THE INVENTION

An object of the present invention is to provide a screen cleaning apparatus which can maintain a good printing performance, even though the apparatus is being used automatically and continuously for a long time, by highly precisely removing paste remaining on the lower surface and inside the pattern openings of a mask having a high-definition and very narrow pattern openings.

In order to attain the above object, a screen printing apparatus in accordance with the present invention includes a mask having pattern openings; a squeegee for forming a pattern through the mask on a substrate, the squeegee being slid on an upper surface of the mask to print the pattern by forcing paste supplied on the upper surface of the mask onto the substrate placed under a lower surface of the mask through the pattern openings; cleaning paper to be brought in contact with the lower surface of the mask; a roller pressing against the lower surface of the mask with the cleaning paper interposed therebetween; roller moving means for moving the roller in a desired direction; and cleaning paper vibrating means for moving the cleaning paper relative to the moving direction of the roller.

The purpose of "moving the cleaning paper relative to the moving direction of the roller" is to provide a screen printing apparatus which can more certainly remove paste attached on the lower surface of the mask by increasing the total contact area of the cleaning paper with the lower surface of the mask, thereby to maintain a good printing performance. As to how to move the cleaning paper relative to the moving direction of the roller, one may employ a method wherein the cleaning paper itself is vibrated, a method wherein the cleaning paper is vibrated indirectly by vibrating the roller and a combination of both. Thus, as to the concept of a "cleaning paper vibrating means" which moves the cleaning paper relative to the moving direction of the roller, either a "roller vibrating means" or a "cleaning paper moving means" are available.

A screen printing apparatus in accordance with the present invention is characterized in that a roller is pressed against the lower surface of a mask with the cleaning paper interposed therebetween and with the cleaning paper being vibrated directly or indirectly, so that the cleaning paper is moved in contact with the mask in a wave-form pattern on the lower surface of the mask. The combined movement may be performed by providing independent movement of the roller and movement of the cleaning paper, or by causing the movement of the cleaning paper to follow the movement of the roller.

Further, another feature of a screen printing apparatus in accordance with the present invention resides in the fact that the screen printing apparatus comprises a control means for adjusting the moving speed of the roller moving means or the vibration speed of a cleaning paper vibrating means corresponding to the distribution of openings in the mask or the material property of the paste being used.

In detail, the present invention provides the apparatuses described below.

The screen printing apparatus in accordance with the present invention forms a pattern on a substrate by sliding a squeegee on an upper surface of a mask having pattern openings to print the pattern by forcing paste supplied on the upper surface of the mask through the pattern openings and onto the substrate placed under a lower surface of the mask, the screen printing apparatus comprising a roller moving means for moving a roller, which presses against the lower surface of the mask with cleaning paper interposed therebetween in contact with the lower surface of the mask, in a desired direction; and a cleaning paper vibrating means for moving or vibrating the cleaning paper in a direction perpendicular to the moving direction of the roller. The cleaning paper vibrating means may be an independently provided apparatus, or the cleaning paper vibrating means may be constructed so to generate a vibration formed by movements of the roller in both X-axis and Y-axis directions or by movement of the roller in the direction of the X-axis and movement of the cleaning paper in the direction of the Y-axis. By doing so, the desired construction can be obtained, since the movements or the vibrations can be composed.

It is preferable when the roller is formed of an elastic body. It is also preferable when the screen printing apparatus comprises a control means for adjusting the speed of operation of the roller moving means, or the speed of movement of the cleaning paper vibrating means, or the speed of vibration of the cleaning paper vibrating means.

It is preferable when the screen printing apparatus comprises a sponge member soaked with a solvent; and a solvent storing tank is provided for supplying the solvent to the sponge member. It is also preferable when the screen printing apparatus comprises a pallet-shaped member, which is in contact with a surface of the mask and moves together with the roller; and a paste residue intake port movable together with the pallet-shaped member while maintaining a gap with the surface of the mask, an air flow path being formed between the surface of the mask and an edge surface of the paste residue intake port; and a suction nozzle movable together with the pallet-shaped member.

The present invention provides a screen printing apparatus which is characterized by the fact that a roller is pressed against the lower surface of a mask with a cleaning paper interposed therebetween and the cleaning paper is vibrated directly or indirectly, so that the cleaning paper is brought into contact with the mask in a wave-form pattern on the lower surface of the mask.

DESCRIPTION OF THE PREFERRED EMBODIMENTS

Figure 1:
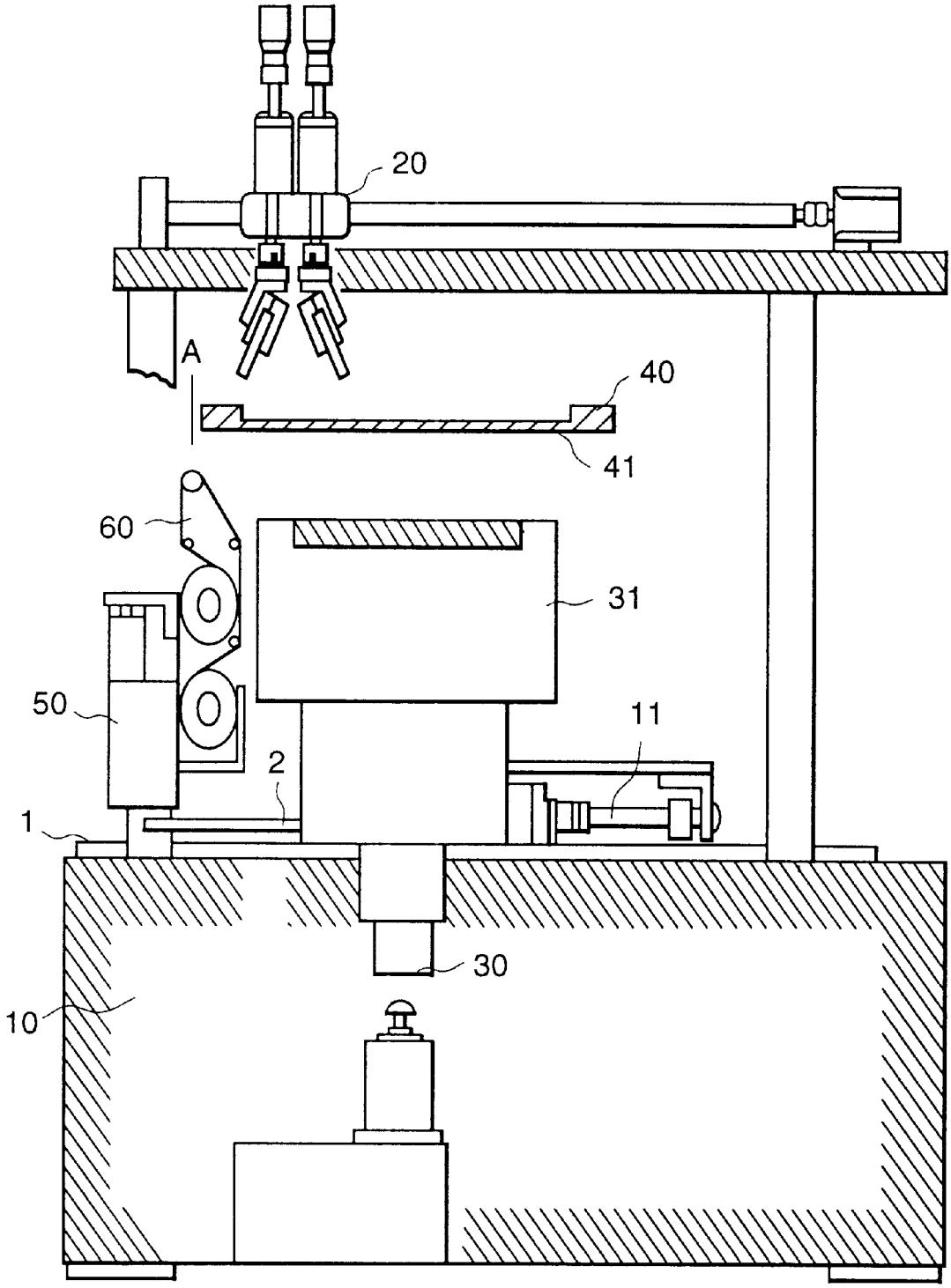
FIG. 1 is a side view showing an embodiment of a screen printing apparatus in accordance with the present invention.

An embodiment of the present invention will be described below with reference to FIG. 1 to FIG. 17. FIG. 1 is a side view showing an embodiment of a screen printing apparatus in accordance with the present invention. The printing apparatus comprises a base frame portion 10, a squeegee portion 20, a table portion 30, a mask portion 40 and a mask cleaning portion (hereinafter, referred to simply as a cleaning portion) 50. A rail 1 for guiding the table portion 30 and the cleaning portion 50 is arranged on the upper surface of the base frame portion 10.

Figure 2:
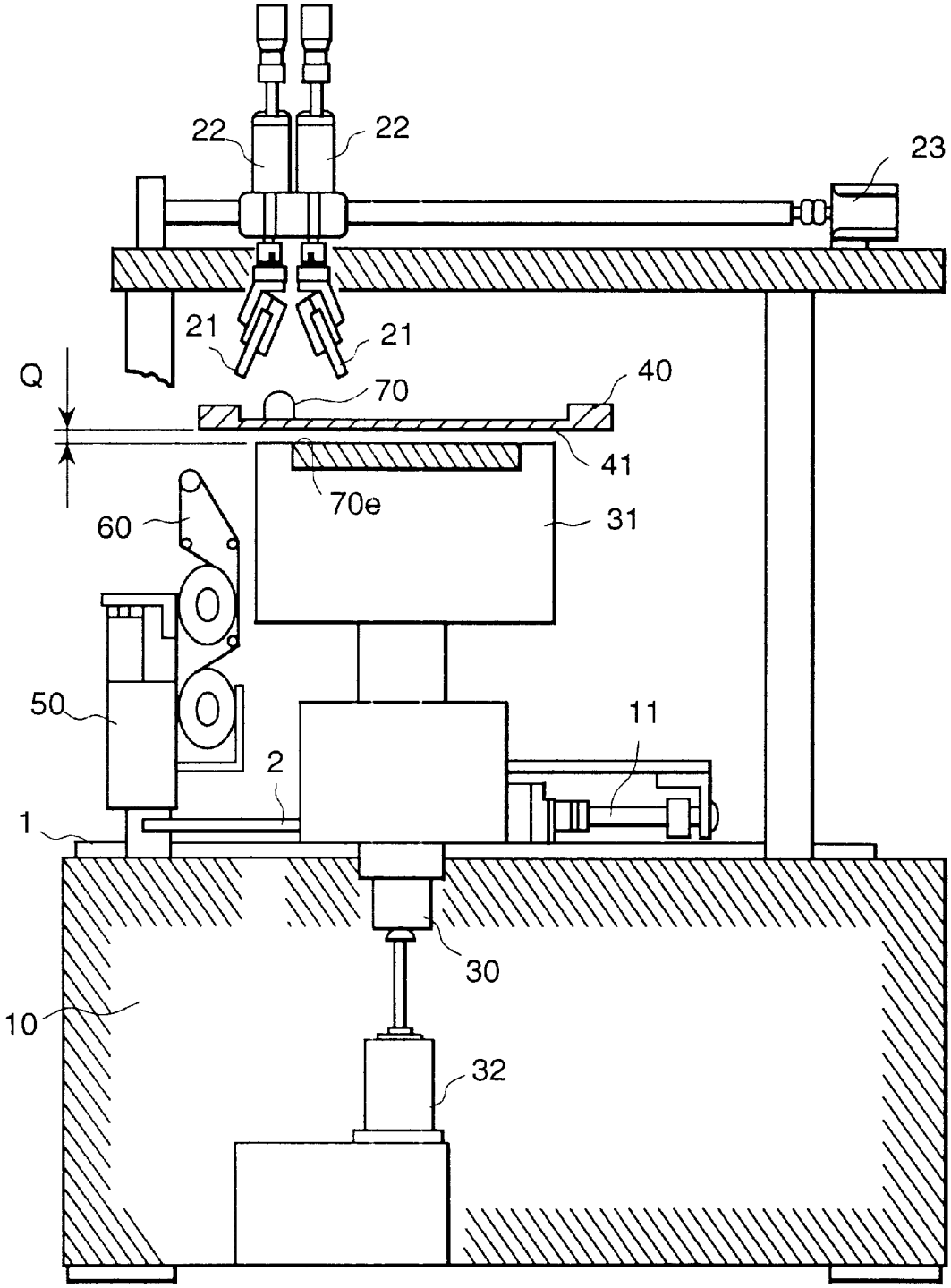
FIG. 2 is a side view showing a state before starting printing in the screen printing apparatus shown in FIG. 1.
Figure 3:
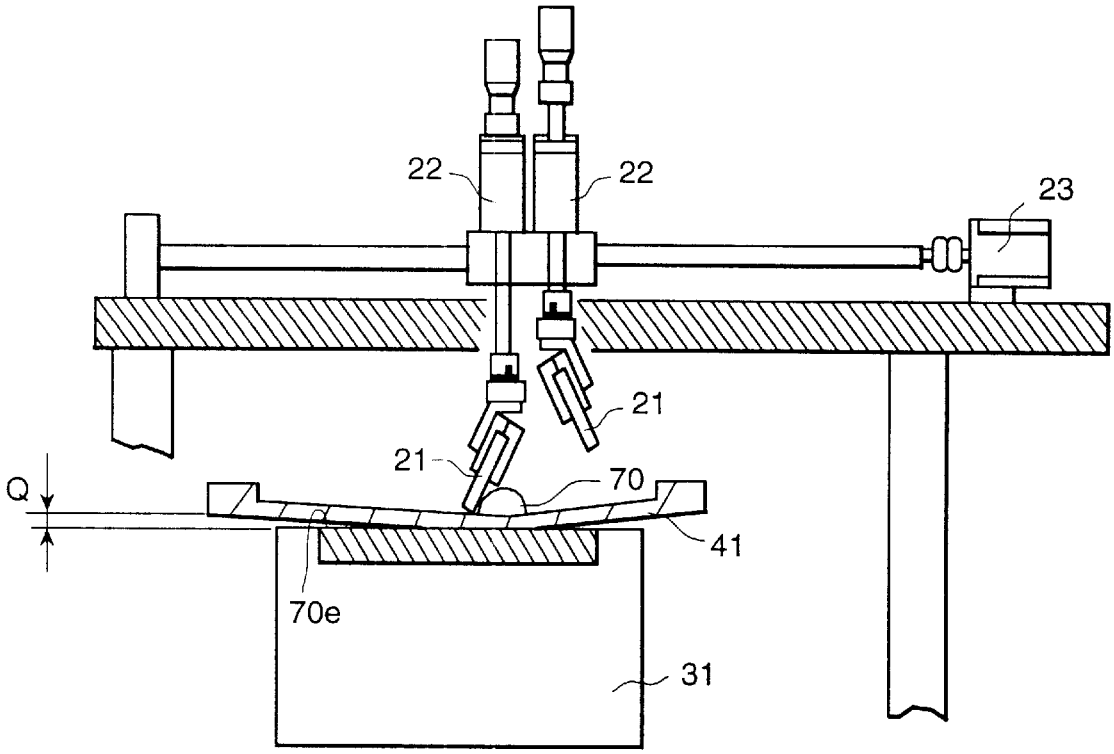
FIG. 3 is an enlarged side view showing a state during printing in the screen printing apparatus shown in FIG. 1.

In the printing apparatus, operating control is performed using a control means, not shown in the figure. During printing, a table 31 of the table portion 30 is moved upward to a position where a preset gap Q is established with the mask 41 using a cylinder 32, as shown in FIG. 2. Then, a squeegee 21 of the squeegee portion 20 arranged above the mask 41 is lowered using a cylinder 22, as shown in FIG. 3. When in position, the squeegee portion 20 is horizontally moved by a motor 23 to print a pattern on an upper surface 70*e* of a material to be printed, for example, a print circuit substrate (hereinafter, referred to simply as a substrate), with paste 70 using the squeegee 21.

Figure 4:
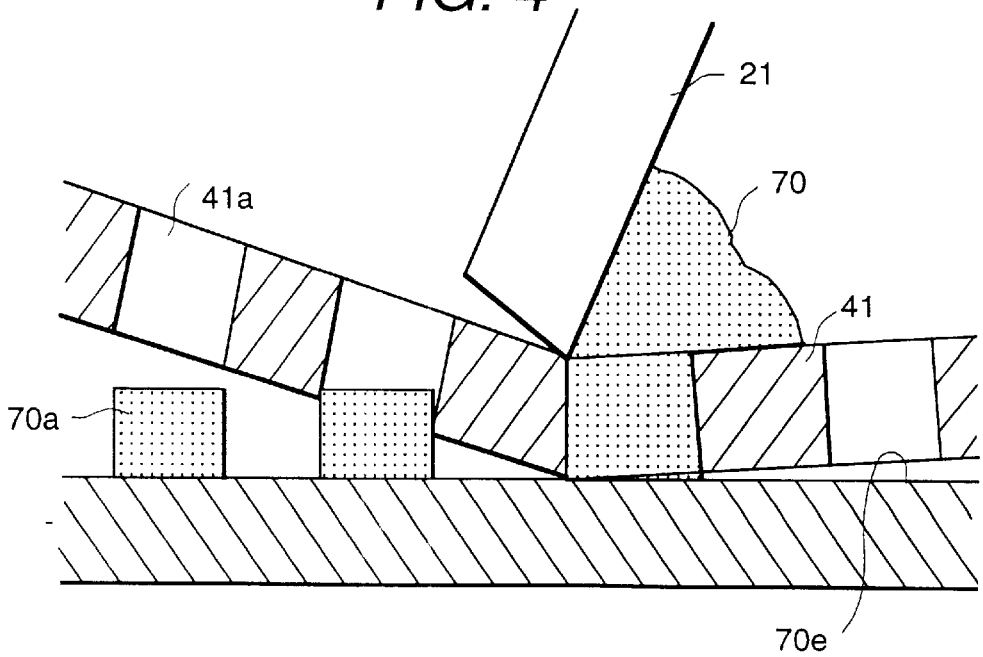
FIG. 4 is an enlarged view showing a squeegee and a mask in the screen printing apparatus of FIG. 3 during printing.
Figure 5:
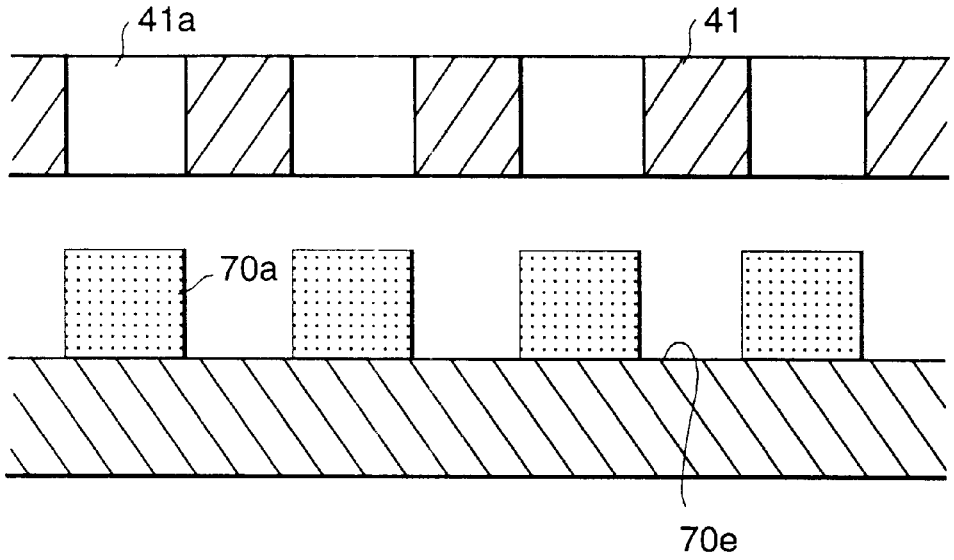
FIG. 5 is a diagrammatic view showing a normal printed state after printing in the screen printing apparatus of FIG. 3.
Figure 6:
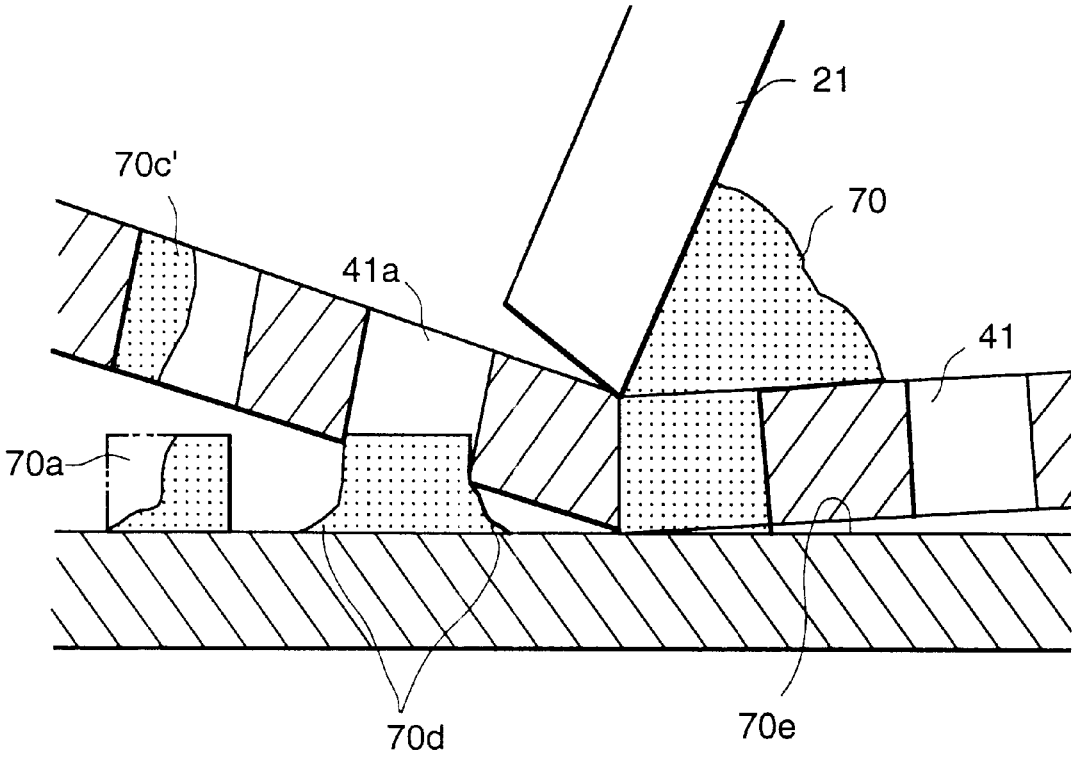
FIG. 6 is a diagrammatic view showing a state of occurrence of a print defect during printing in the screen printing apparatus of FIG. 3.
Figure 7:
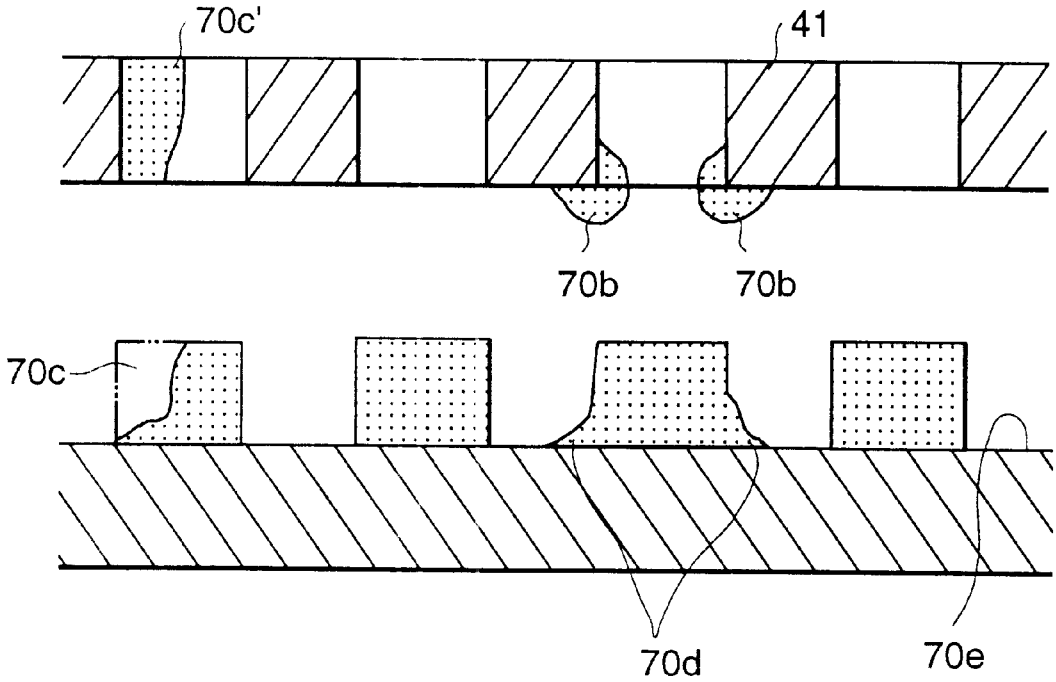
FIG. 7 is a diagrammatic view showing a state of occurrence of a print defect after printing in the screen printing apparatus of FIG. 3.

The cleaning portion 50 is not used when the printing is normal, that is, when blurring does not occur or when remnants of the paste 70 exist and clogging does not occur inside a pattern opening 41*a*, as shown in FIG. 4. In such case, the paste 70*a* is clearly transferred, as shown in FIG. 5. However, when blurring 70*d* or clogging 70*c*, occurs, as shown in FIG. 6, or when remnants of paste 70*b* are left in the mask 41, as shown in FIG. 7, a printing defect in the form of a dimness 70*c* or blurring 70*d* of the paste, as shown in FIG. 7, occurs in the upper surface of the substrate 70*e*. In such case, the cleaning portion 50 is used during a necessary number of cycles after a preset number of printing operations, as determined from the frequency of occurrence of the printing defects.

Operation of the cleaning portion 50 will be described below with reference to FIG. 1 and FIG. 8 to FIG. 10.

Figure 8:
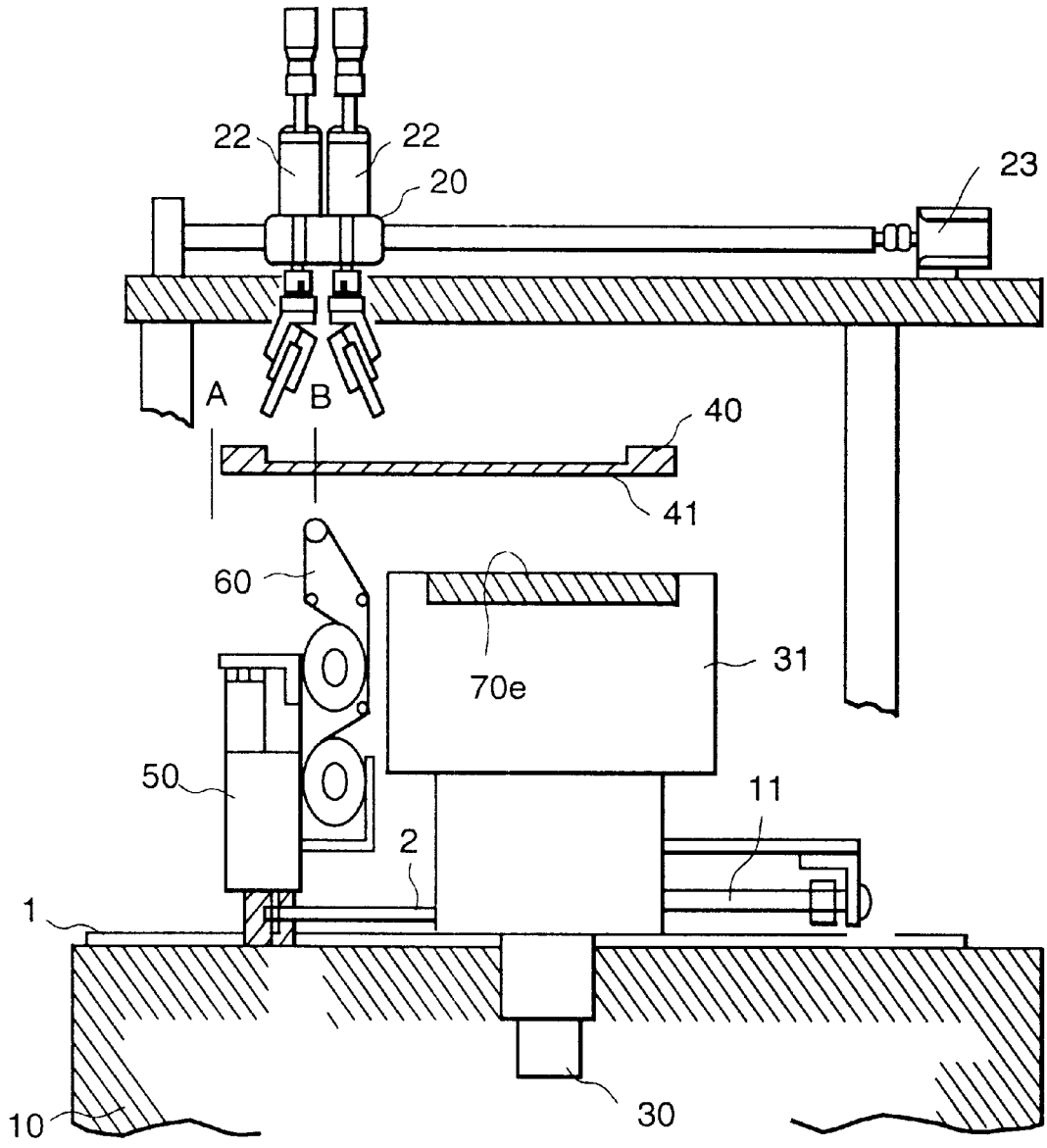
FIG. 8 is a side view showing a state before mask cleaning in the screen printing apparatus shown in FIG. 1.
Figure 9:
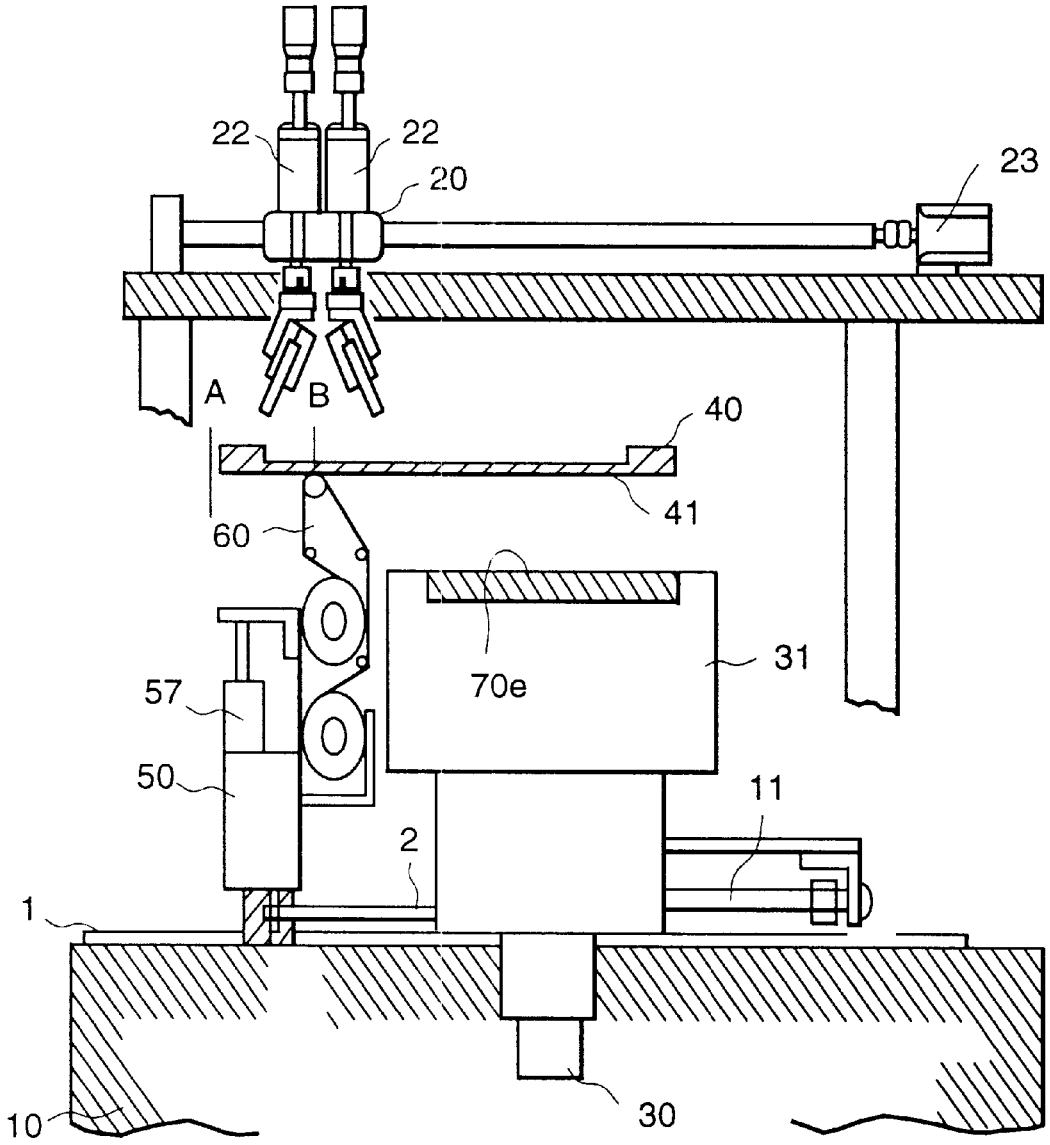
FIG. 9 is a side view showing a state at the start of mask cleaning in the screen printing apparatus shown in FIG.
Figure 10:
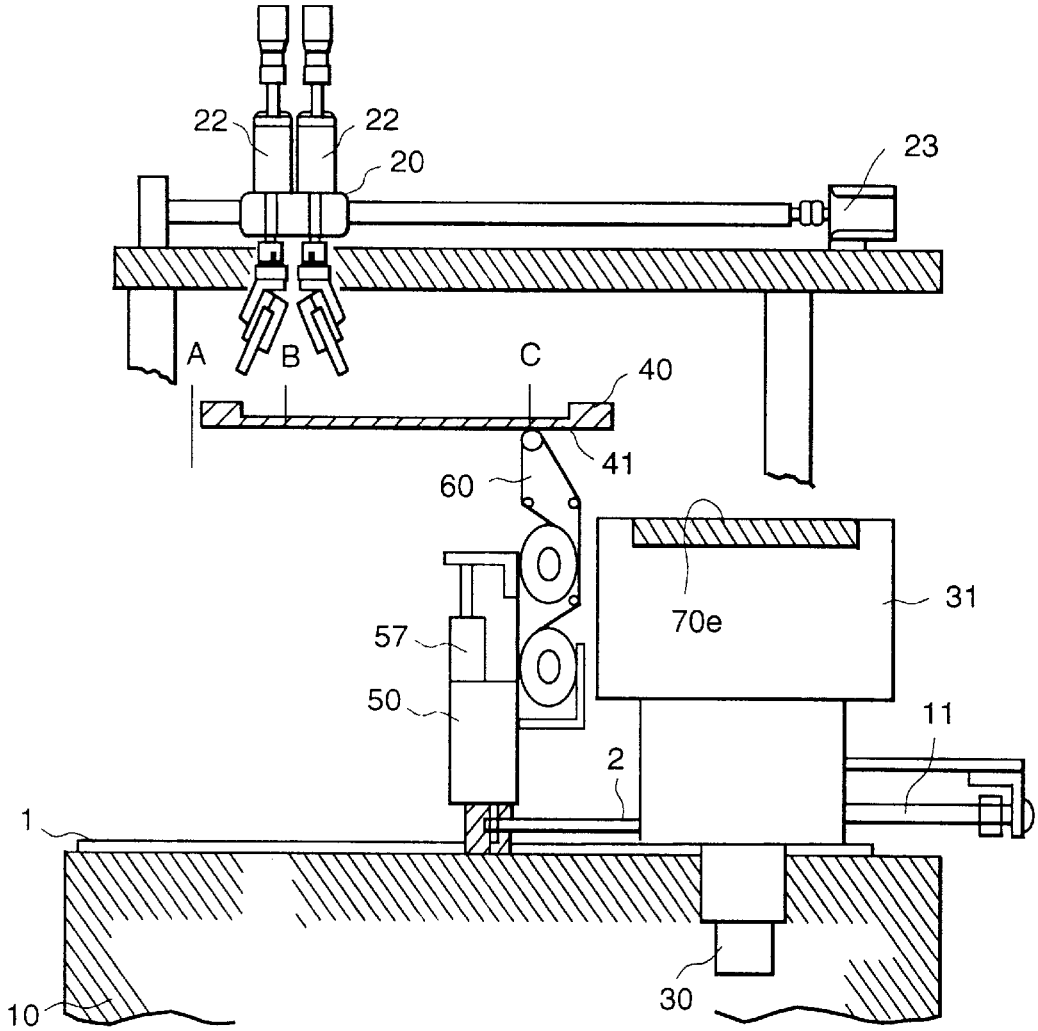
FIG. 10 is a side view showing a state at the time of completion of mask cleaning in the screen printing apparatus shown in FIG. 1.

The cleaning portion 50 is placed at a position A below the mask 41 at the start of cleaning, as shown in FIG. 1. Then, as shown in FIG. 8, the cleaning portion 50, which is linked to the table portion 30 by way of a link plate 2, is moved up to a preset position B along the rail 1 together with the table portion 30 by a cylinder 11. After being moved into position, a cleaning roller portion 60 is moved upward to a preset level where it presses against the lower surface of the mask 41 using a cylinder 57, as shown in FIG. 9. Then, the cleaning roller portion 60 is moved up to a position C while always maintaining a state in which a tension is applied to the lower surface of the mask 41, as shown in FIG. 10.

Figure 11:
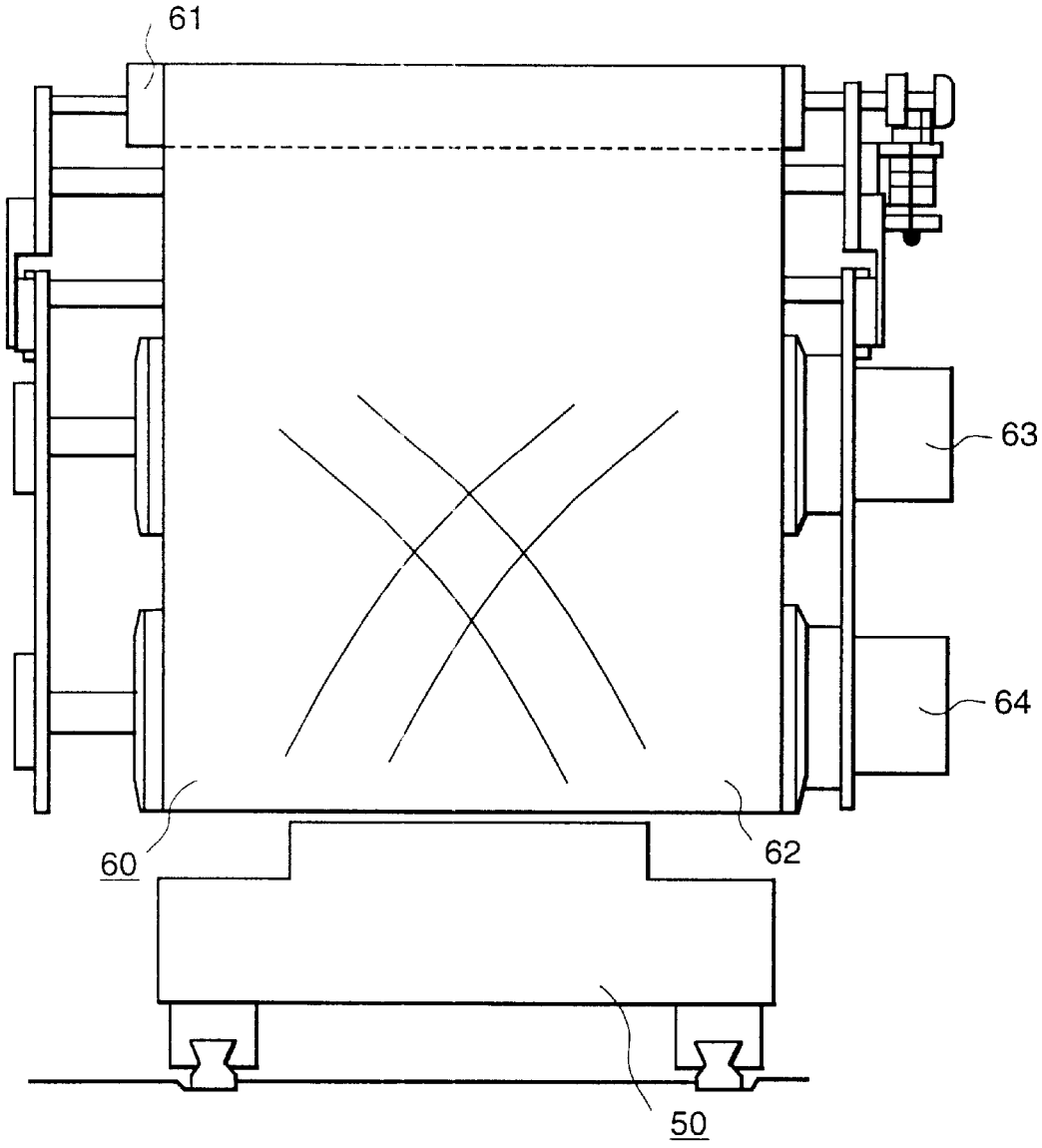
FIG. 11 is a front view showing the cleaning roller portion including the roller vibrating means in the screen printing apparatus shown in FIG. 1.
Figure 12:
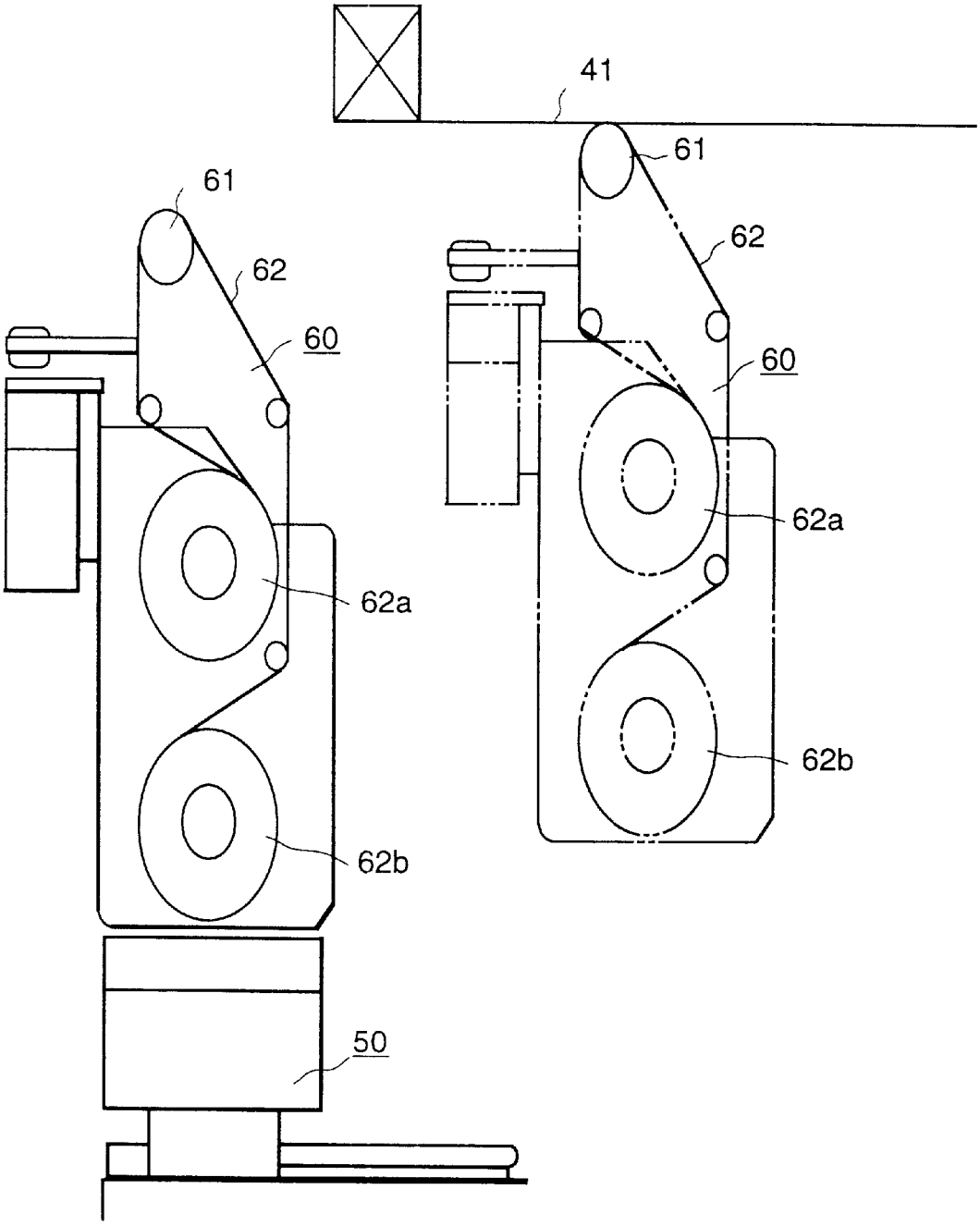
FIG. 12 is a side view showing the screen cleaning roller portion shown in FIG. 11.

An example of the construction of the cleaning roller portion 60 in the cleaning portion 50 will be explained below with reference to FIG. 11 and FIG. 12. FIG. 11 is a front view of the cleaning portion 50, and FIG. 12 is a side view of FIG. 11.

The cleaning roller portion 60 uses less fuzzy roll-shaped paper 62 as the cleaning paper, and the roll paper 62, which is drawn out from a paper supply roll 62*a*, passes around the outer periphery of a roller 61 and is wound around a used paper take-up roll 62*b*. A rubber roller having a high elasticity is used as the roller 61. Therefore, the paper 62 is brought into contact with the lower surface of the mask 41 by the roller 61, and the roller 61 is pressed against the mask with the roll paper 62 interposed therebetween. Motors 63, 64 are respectively provided to drive the paper supply roll 62*a* and the used paper take-up roll 62*b*, so that the portion of the paper in contact with the lower surface of the mask 41 can be always kept in a clean state by continuously winding the paper 62 by driving the motors 63 and 64. Therein, the motors 63 and 64 may be driven either during or after operation of the cleaning portion 50. That is, the winding frequency may be set depending on the printing state or the cleaning state.

A moving means for moving the roller 61 and a roller vibrating means for vibrating the roller 61 to vibrate the roll paper are arranged at one end of the roller 61. A vibration function provided in the roller vibrating means can be attained by vibrating the roll paper itself. The key point is that the roll paper is vibrated while being moved in waveform pattern.

Operations of the moving means for moving the roller 61 and the roller vibrating means for vibrating the roller to vibrate the roll paper will be described below with reference to FIG. 13(*a*) and FIG. 13(*b*), which show the roller vibrating means as seen from above.

Figure 13A:
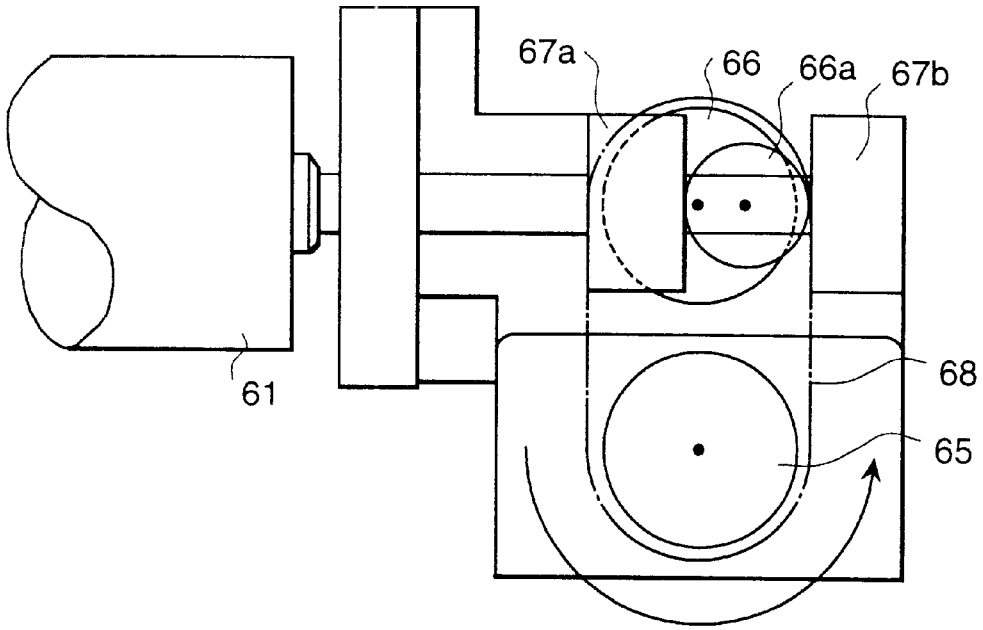
FIGS. 13(*a*) and 13(*b*) are enlarged top plan views showing the top surface of the roller vibrating means of the cleaning roller portion shown in FIG. 11.
Figure 13B:
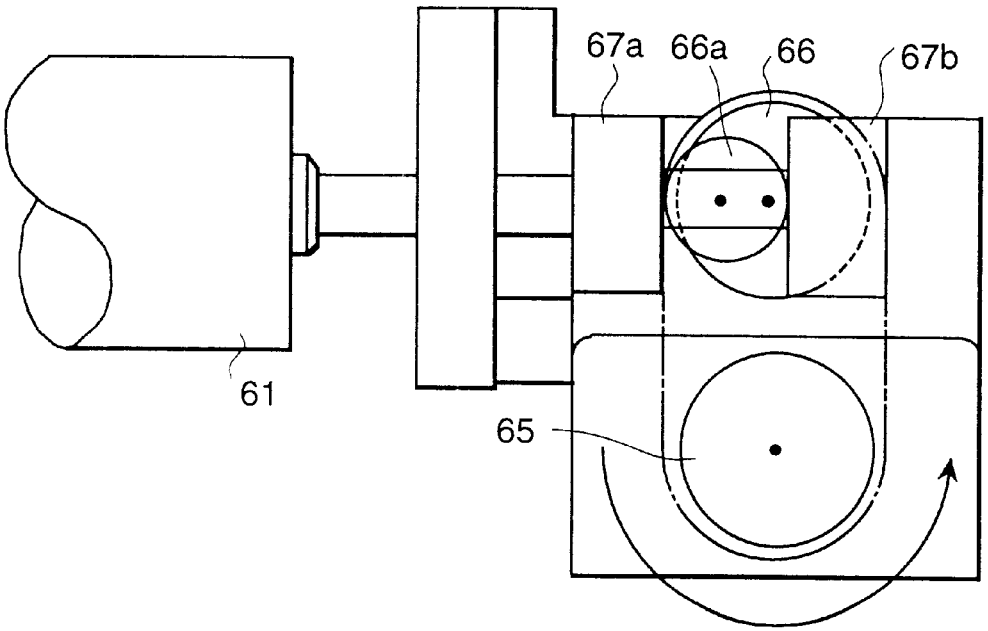

As shown in FIG. 13(*a*), a roller vibrating piece 67*a* (hereinafter, referred to simply as piece 67*a*) is fixed to one end of the shaft of the roller 61, and a roller vibrating piece 67*b* (hereinafter, referred to as piece 67*b*) is fixed to the same end of the shaft of the roller 61 with a preset spacing relative to the piece 67*a*. Further, a projecting portion 66*a* of a roller vibrating rotating plate 66 (hereinafter, referred to simply as disk 66) is positioned between the piece 67*a* and the piece 67*b*, so that the projecting portion 66*a* is sandwiched by the pieces 67*a* and 67*b*. The disk 66 placed below the pieces 67*a*, 67*b* is coupled to a motor 65 through a belt 68, so that the projecting portion 66*a* is rotated in a circle around the rotating center of the disk 66 as an origin when the disk 66 is rotated by the motor 65. FIG. 13(*b*) shows a state in which the disk 66*a* is rotated by 180° from the state of FIG. 13(*a*). Since the projecting portion 66*a* pushes the piece 67*a* to the left during 180° of its rotation and pushes the piece 67*b* to the right during the other 180° of its rotation when the disk is rotated, the pieces 67*a*, 67*b* are moved back and forth in the horizontal direction. Therefore, since the roller 61 is moved and vibrated in the horizontal direction, the roll paper 62 placed under the mask 41 is moved and vibrated in the horizontal direction following the movement of the roller 61 in a plane substantially parallel to a plane of a lower surface of the mask 41.

Figure 14:
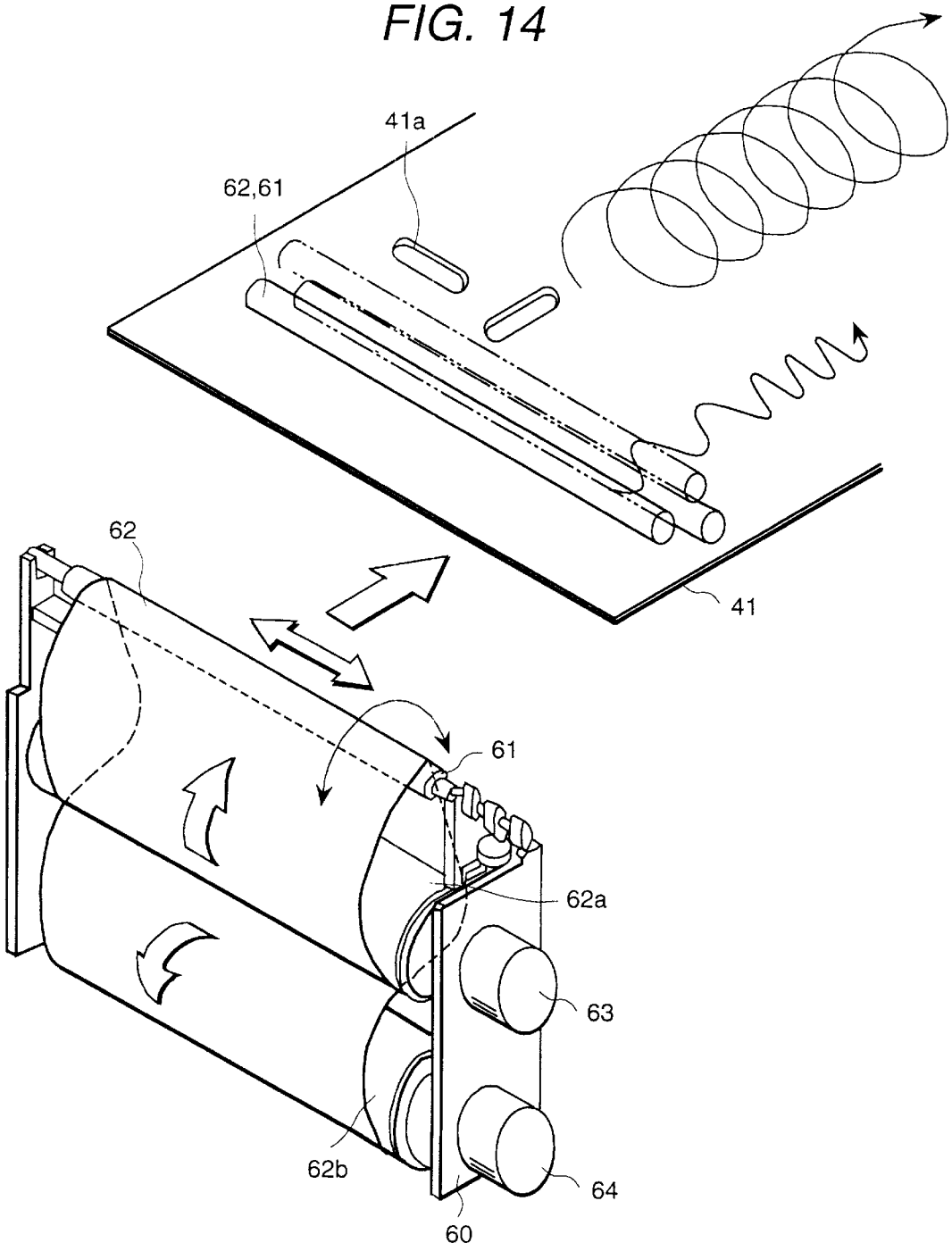
FIG. 14 is a perspective view for explaining the operation of the cleaning roller portion shown in FIG. 11.

FIG. 14 shows the positional relationship between the cleaning roller portion 60 and the mask 41. The cleaning operation will be described below with reference to FIG. 14.

For example, it is assumed that by driving the motors 63, 64, the roll paper 62 is wound from supply roll 62*a* to take-up roll 62*b* so as to always bring a clean portion of the roll paper 62 into contact with the mask 41. Then, the cleaning portion 60 is moved upward by the moving means (not shown in the figure), and the roller 61 is pressed against the lower surface of the mask 41 with the roll paper 62 interposed therebetween, so that the roll paper 62 is pushed by the roller 61 into contact with the lower surface of the mask 41.

Figure 15:
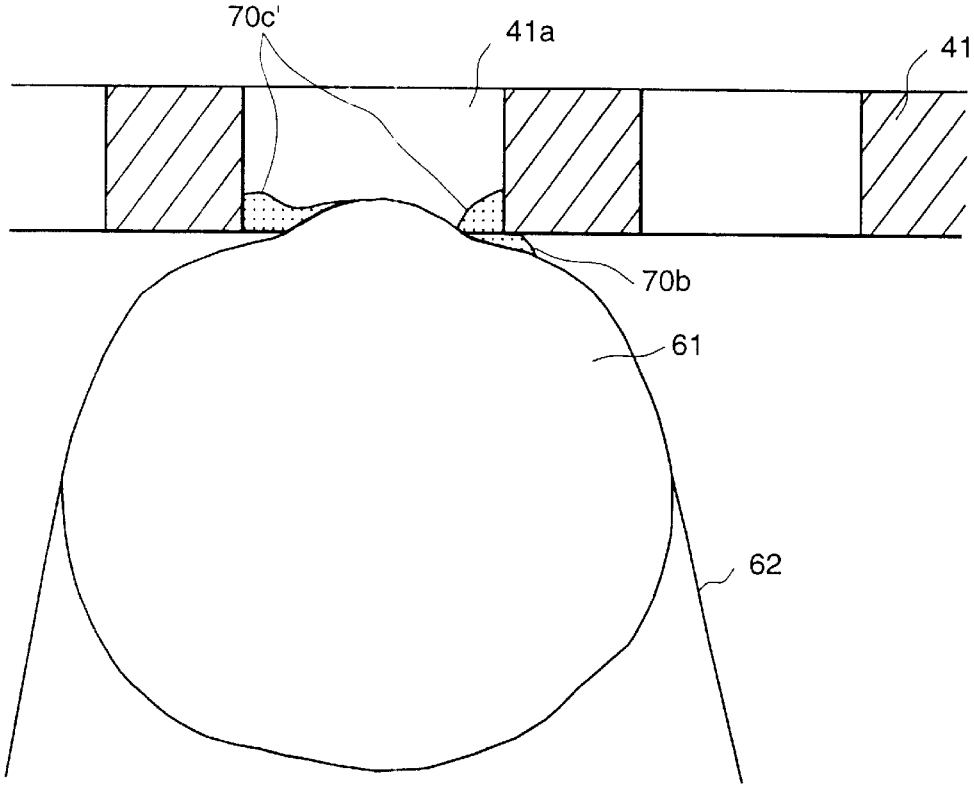
FIG. 15 is an enlarged diagrammatic view showing the cleaning roller portion shown in FIG. 11 during cleaning.

In a case where a rubber roller having an elasticity is used for the roller 61, when the roller 61 is pushed against the lower surface of the mask 41, the roller 61 will be deformed so that it applies a tension to the lower surface of the mask 41 through the roll paper 62. The amount of the deformation of the roller 61 can be arbitrarily changed by selecting the elasticity of the roller 61 itself and controlling the force of the roller 61 against the lower surface of the mask. For example, the roller 61 can be deformed to such a large extent as to cover a mask opening portion having the maximum opening area in the mask. Since the roller portion 61 is deformed sufficiently to enter into the pattern opening portion 41*a*, the roller portion 61 is brought into contact with an area wider than the area of the opening on the lower surface of the mask 41, and, accordingly, the roll paper 62 is also brought into contact with an area wider than the area of the opening on the lower surface of the mask 41. Therefore, together with the cleaning motion in the shape of a sinusoidal wave to be described later, it is possible to wipe off the paste 70*b* attached onto the lower surface of the mask 41 and to scrape out the paste 70*c*', remaining on the surface inside the pattern opening portion 41*a*, as seen in FIG. 15.

The cleaning roller portion 60 is moved from the lower left hand side toward the upper right hand side, as seen in FIG. 14, while the roll paper 62 is maintained in contact with the lower surface of the mask 41, and, at the same time, the roller 61 is vibrated between the upper left hand side and the lower right hand side in FIG. 14, i.e. parallel to the surface of the mask 41, as described previously with reference to FIG. 13. The roller 61 and the roll paper 62 illustrated by solid lines and by double-dot-dash lines in the mask 41 show an example of positions of the roller 61 when the disk 66 is rotated by the motor 65 to vibrate the roller 61. When the motor 65 is continuously operated, a locus of an arbitrary point on the roll paper 62 in contact with the lower surface of the mask 41 becomes a sinusoidal wave, while the roll paper 62 is being vibrated following the vibration of the roller 61. That is, the roll paper 62 is in contact with the lower surface of the mask 41, while it is being stretched between the paper supply roll 62*a* and the paper take-up roll 62*b* with a tension force to a degree that the paper will not tear when the roll paper 62 is being vibrated following the vibration of the roller 61. Therefore, the roll paper 62 can be moved by the friction force of the roller 61 so as to follow the vibration of the roller 61. Further, the tension of the roll paper 62 may be arbitrarily selected depending on the friction coefficient of the roll paper 62 on the roller 61.

When the motor 65 is not operated at all, that is, when the roller 61 is not vibrated, the locus of the arbitrary point on the roll paper becomes a straight line. The vibration waveform may be a rectangular wave or a triangular wave instead of the sinusoidal wave. It is preferable to appropriately select the waveform depending on the distribution of the mask openings.

That is, by vibrating the roller 61, while it is pressed against the lower surface of the mask 41 with the roll paper 62 interposed therebetween, in a direction perpendicular to the moving direction of the cleaning portion 50, while the roller 61 is being moved together with the movement of the cleaning portion 50, the moving locus of an arbitrary point on the roll paper 62 becomes longer than that in a well known case of simple vibration, and, accordingly, the cumulative contact area of the roll paper 62 on the lower surface of the mask 41 is increased.

Therefore, since number of moving operations of the cleaning portion 50 (number of cleaning operations) does not need to be increased, the cleaning efficiency can be improved without increasing the time required for the mask cleaning.

Further, by repetitively driving the motor 63 and the motor 64 forward and backward, instead of only in one direction, to alternatively move the roll paper 62 forward and back over the roller 61, the moving locus of the roll paper 62 in contact with the lower surface of the mask 41 can be formed as a spiral to increase the cumulative contact area of the roll paper 62 on the lower surface of the mask 41.

Figure 16:
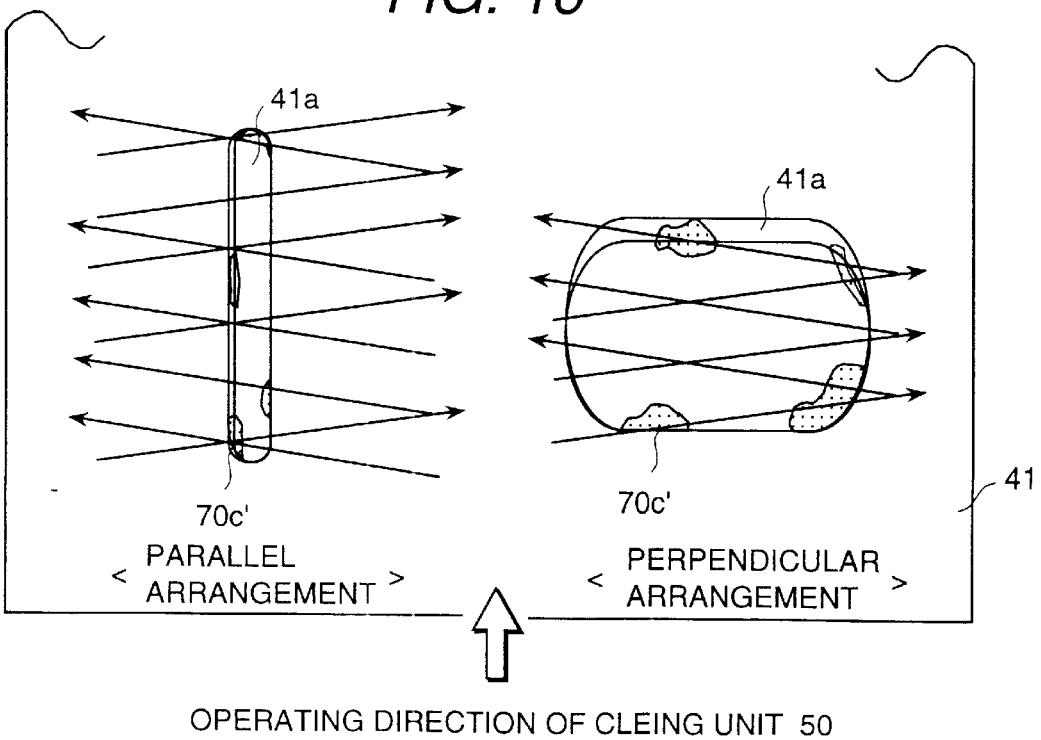
FIG. 16 is a schematic view showing the operation of the cleaning roller portion shown in FIG. 11.

Further, the roll paper is vibrated in contact with the pattern opening portion 41*a* with a changing angle relative to the pattern opening portion, as shown in FIG. 16. Therefore, whether the shape (longitudinal direction) of the pattern opening portion 41*a* is perpendicular or parallel to the moving direction of the cleaning portion 50, the opening surface of the pattern opening portion 41*a* can be uniformly cleaned without being affected by the area or the orientation of the pattern opening portion 41*a* since the contact area is increased.

Furthermore, the vibration speed of the roller 61 as it vibrates in a direction perpendicular to the moving direction of the cleaning portion 50 can be arbitrarily set and changed by arbitrarily setting and changing the driving condition of the motor 65 using a control means, not shown in the figure. Thus, the roll paper can be vibrated together with the roller 61 by arbitrarily setting and changing the driving condition of the motor 65, and, accordingly, a cumulative contact surface of the roll paper 62 can be arbitrarily obtained. Therefore, cleaning of the mask can be appropriately performed without regard to the pattern of the mask 41, even in a case where the distribution of the opening ratio in one mask is not uniform as well as in a case where a mask is replaced by one having a different opening ratio.

Figure 17:
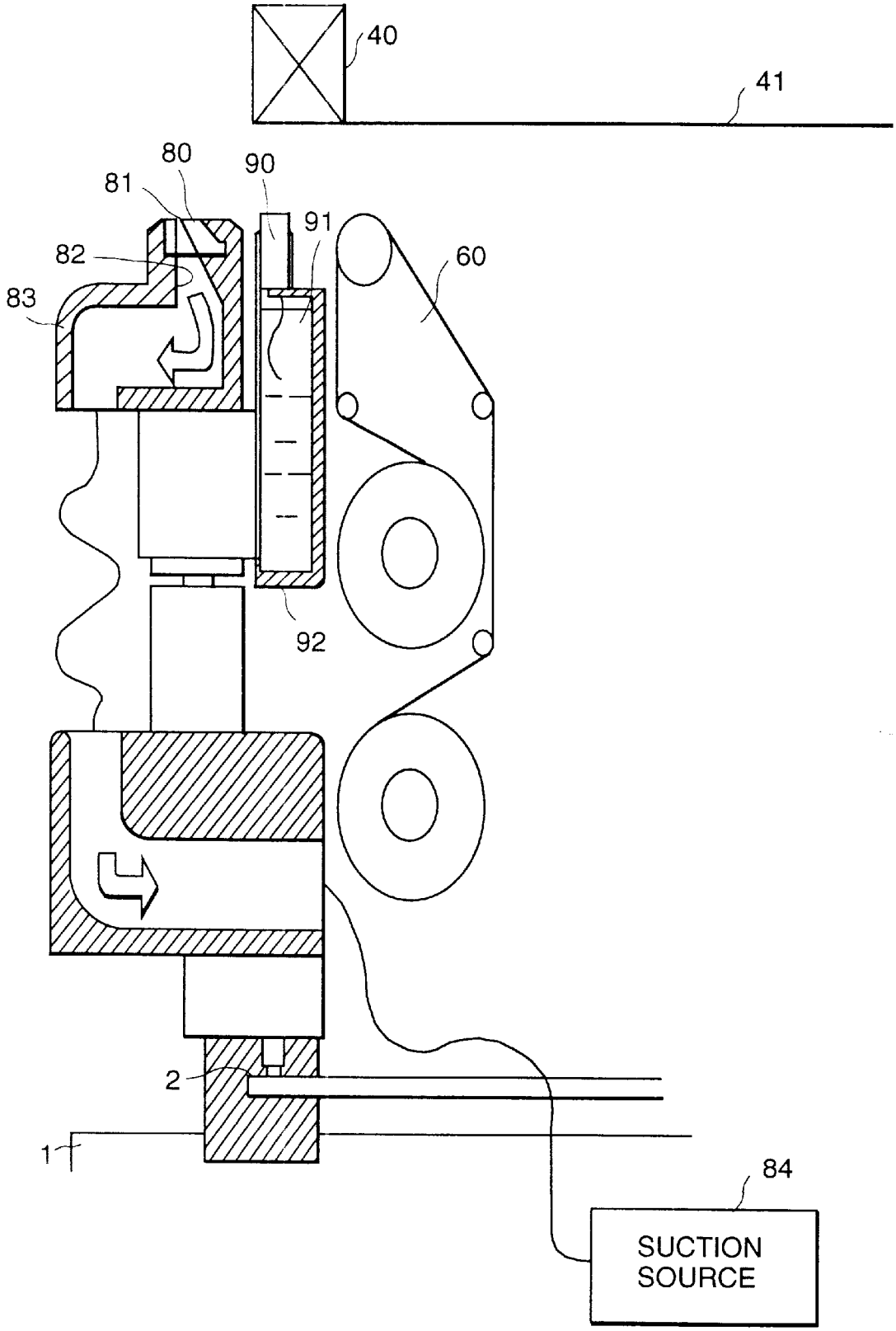
FIG. 17 is an enlarged view showing another embodiment of a cleaning roller portion of a screen printing apparatus in accordance with the present invention.

In order to perform cleaning of a, mask in a case where the paste being used has a high viscosity or is easily dried, as shown in FIG. 17, the screen printing apparatus may comprise a wet cleaning apparatus 92 having a sponge member 90 in which a solvent is soaked; and a solvent storing tank 91 for supplying the solvent to the sponge member 90. The apparatus may also comprise a pallet-shaped member 80; a paste residue intake port 81 movable together with the pallet-shaped member 80 while maintaining a gap relative to the lower surface of the mask 41; and a suction scraping cleaning apparatus 83 having a suction nozzle 82 movable together with the pallet-shaped member 80, with an air flow passage being formed between the lower surface of the mask 41 and an edge surface of the paste residue intake port 81. Therein, a sucking action through the suction nozzle 82 is performed by a suction source 84.

That is, after cleaning the mask 41 using the cleaning roller portion 60 described above, any remaining paste, which is not removed by the cleaning roller portion 60 and which remains on the lower surface of the mask 41, is wiped and removed by the sponge member 90 in which the solvent is soaked, and paste which may be pushed into the inside of the opening portion 41*a* by the sponge member 90 is removed by vacuum sucking. Thereby, the paste which remains on the mask 41 in spite of the cleaning action of the paper can be certainly removed. The type and the position of installation of the various kinds of cleaning apparatuses (the wet cleaning apparatus 92, the suction scraping cleaning apparatus 83 and the like) are not limited to the arrangement shown in FIG. 17, but can be changed depending on various conditions and properties of the paste, such as viscosity, the drying property and so on, as well as the shape and the distribution of the opening portions of the mask.

In the embodiments of the present invention described above with reference to FIG. 1 to FIG. 17, the roller 61 is moved and vibrated using one apparatus, that is, the roll paper is moved and vibrated following the movement and vibration of the roller 61. However, it is possible, for example, to provide a vibrating means in supporting portions of the winding motors 63, 64 to vibrate the roll paper 62 alone and not vibrate the roller 61.

Figure 18:
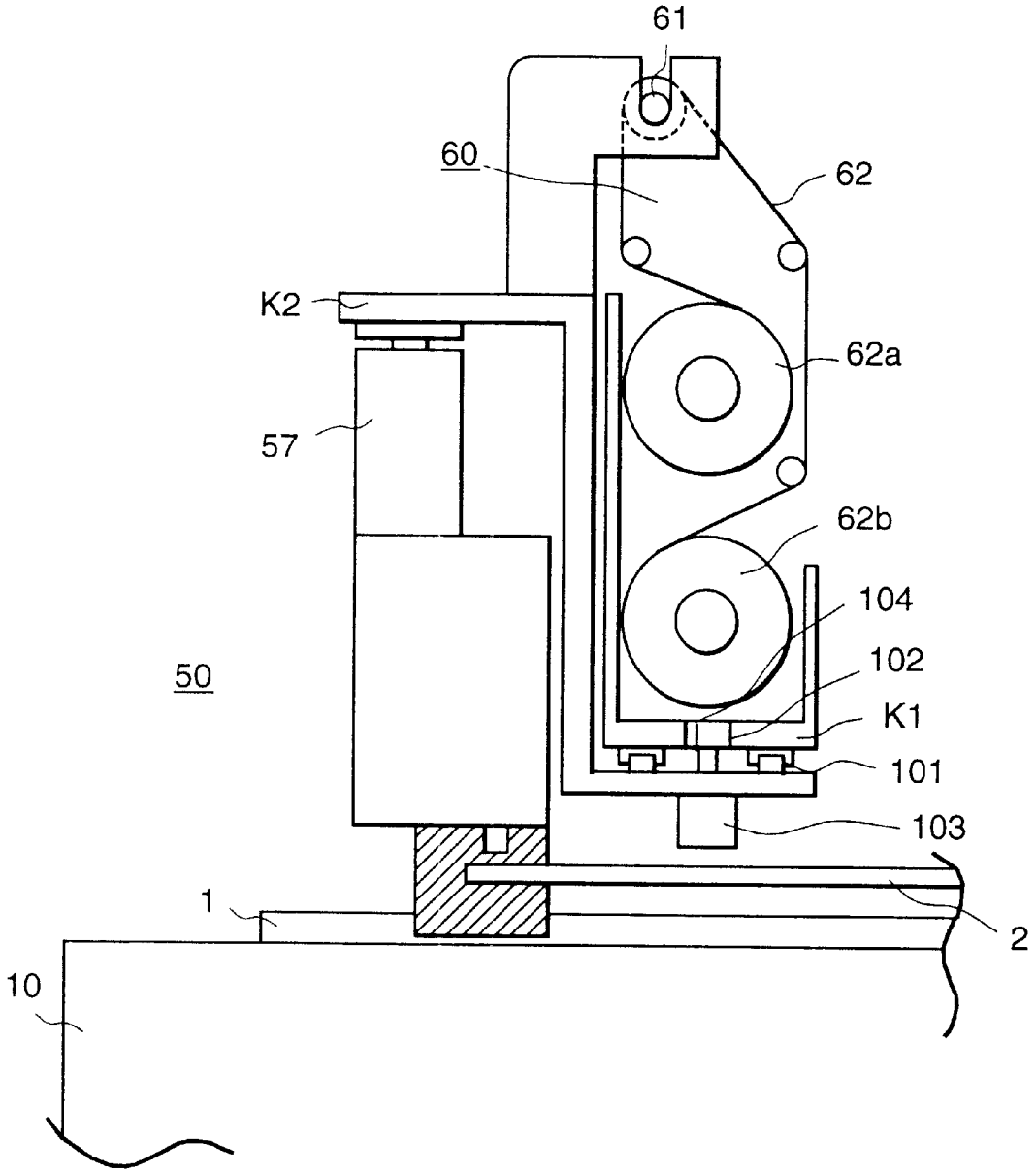
FIG. 18 is a side view showing a cleaning paper moving means of a cleaning roller portion in a still other embodiment in accordance with the present invention.
Figure 19:
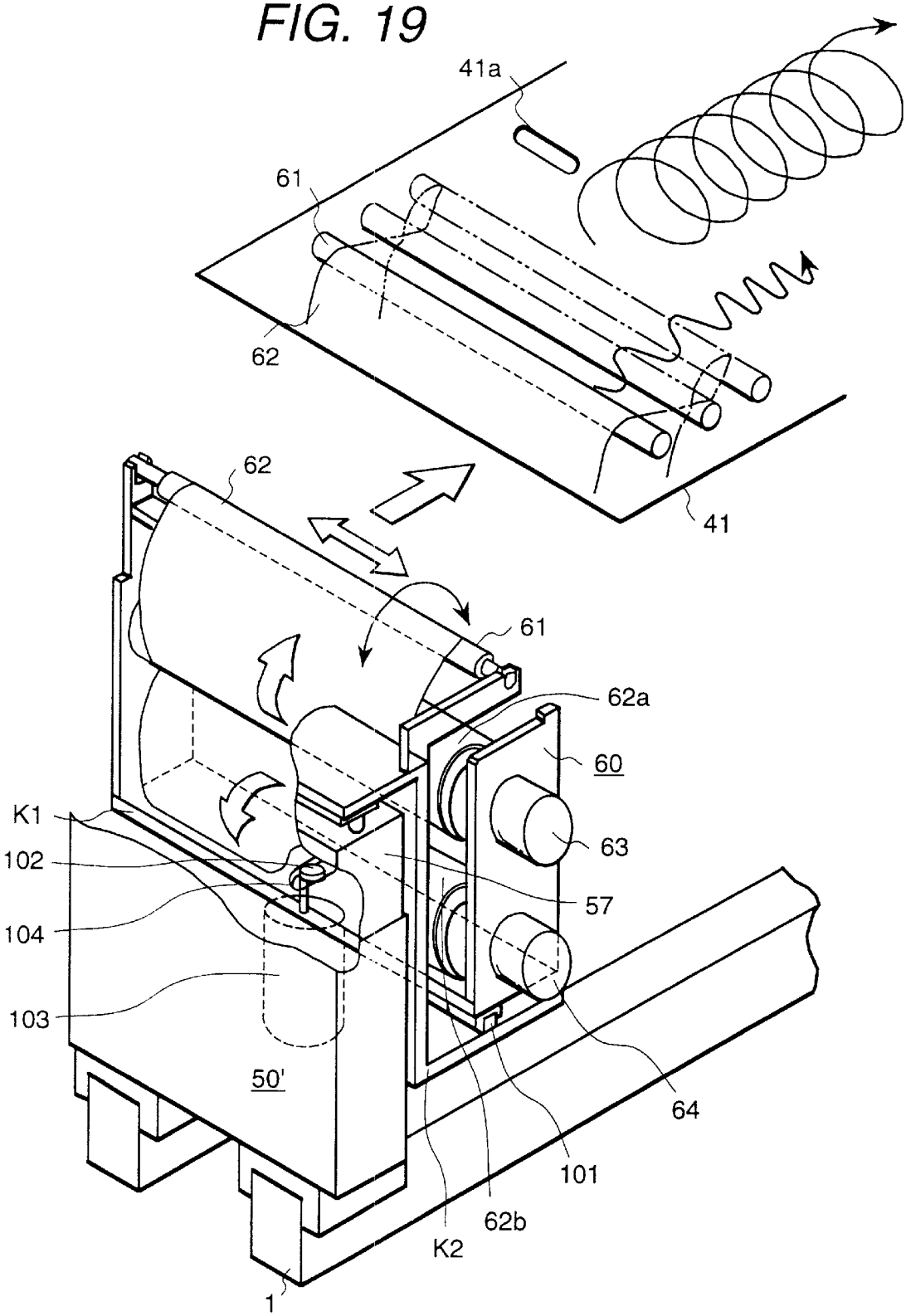
FIG. 19 is a perspective view for explaining the operation of the cleaning paper moving means shown in FIG. 18.

FIG. 18 and FIG. 19 show another embodiment of a cleaning portion 50' having a cleaning paper moving means for vibrating the cleaning paper itself, instead of the roller vibrating means, in accordance with the present invention. Therein, like parts in the embodiments shown in FIG. 1 to FIG. 17 are identified by the same reference numerals, and a detailed description thereof will be omitted.

As shown in FIG. 18 and FIG. 19, a base frame K1 holding the paper supply roll 62*a*, the paper take-up roll 62*b* and the motors 63, 64 as a unit, and a base frame K2 holding the roller 61 are provided in the cleaning portion 50'.

The base frame K2 carries a motor 103 the driving shaft of which is connected to an eccentric cam 102, and the eccentric cam 102 is inserted into an elongated hole 104 provided in the base frame K1. When the motor 103 is operated to rotate the eccentric cam 102, the base frame K1 will be moved back and forth along a rail 101 in a direction perpendicular to the moving direction of the cleaning portion 50'.

That is, when the cleaning portion 50' is moved in the vertical direction, the base frame K1 and the base frame K2 are moved together in the vertical direction by a cylinder 57 to bring the roller 61 in contact with the lower surface of the mask 41 with the cleaning paper 62 interposed therebetween. Then, the cleaning portion 50' is moved in a direction parallel to the lower surface of the mask 41 along the rail 1. When the motor 103 is operated at that time, while the base frame K2 holding the roller 61 is moved in the same direction as the cleaning portion 50', the base frame K1 is vibrated back and forth in a direction perpendicular to the moving direction of the cleaning portion 50'. Therefore, the cleaning paper 62 is vibrated with respect to the roller 61.

In other words, in contrast to the embodiments shown in FIG. 1 to FIG. 17, the roller 61 in this embodiment of the cleaning paper moving means is linearly moved as the cleaning portion 50' is moved, while the roller 61 is maintained in contact with the lower surface of the mask 41 with the cleaning paper 62 interposed therebetween. At that time, since the cleaning paper 62 is vibrated with respect to the roller 61, cleaning movement with a sinusoidal waveform by the cleaning paper 62 occurs at the lower surface of the mask 41.

Therefore, a locus of an arbitrary point on the roll paper 62 traces a sinusoidal waveform due to vibration of the cleaning paper 62 caused by the cleaning paper moving means.

Further, in each of the embodiments of the present invention described above with reference to FIG. 1 to FIG. 19, it has been indicated that the moving direction of the roller moving means is the same as the sliding direction of the squeegee, and the moving direction or the vibrating direction of the cleaning paper is perpendicular to the sliding direction of the squeegee. However, it is possible for the moving direction of the roller moving means to be perpendicular to the sliding direction of the squeegee, and the moving direction or the vibrating direction of the cleaning paper to be the same as the sliding direction of the squeegee.

As described above, according to the present invention, the moving locus of an arbitrary point on the roll paper becomes longer than that in a case of no vibration or a case of simple vibration, and, accordingly, the cumulative contact area of the roll paper on the lower surface of the mask is increased. In detail, by providing the roller moving means for moving a roller, which is pressed against the lower surface of the mask with the cleaning paper in contact with the lower surface of the mask, in a desired direction, and by providing the cleaning paper vibrating means for moving or vibrating the cleaning paper in a direction perpendicular to the moving direction of the roller moving means, the cleaning paper in contact with the lower surface of the mask is compositely moved and vibrated to certainly remove paste attached to the lower surface of the mask. Accordingly, a screen printing apparatus capable of maintaining a good printing performance can be provided.

Further, according to the present invention, by providing control means for adjusting the moving speed of the roller moving means or the vibration speed of the cleaning paper vibrating means corresponding to the distribution of opening portions in the mask or the property of the paste, an optimized cleaning can be performed at the surface of the pattern opening of the mask. Accordingly, a screen printing apparatus capable of maintaining a good printing performance can be provided.

What is claimed is:

1. A screen printing apparatus, comprising:

a mask having pattern openings;

a squeegee for forming a pattern on a substrate, the squeegee being slid on an upper surface of said mask to print the pattern by forcing paste supplied on the upper surface of said mask onto the substrate placed under a lower surface of said mask through the pattern openings;

cleaning paper to be brought into contact with the lower surface of said mask;

a roller pressed against the lower surface of said mask with said cleaning paper interposed therebetween;

roller moving means for moving said roller in a desired direction with respect to the lower surface of said mask;

cleaning paper vibrating means for vibrating said cleaning paper in a plane substantially parallel to a plane of the lower surface of said mask while said roller moves in the desired direction; and cleaning paper moving means for alternately moving said cleaning paper forward and backward over said roller while said roller moves in the desired direction.

2. A screen printing apparatus according to claim 1, wherein said cleaning paper vibrating means vibrates said cleaning paper in a direction transverse to the moving direction of said roller moving means.

3. A screen printing apparatus according to claim 1, wherein said cleaning paper vibrating means vibrates said cleaning paper in a direction perpendicular to a sliding direction of said squeegee.

4. A screen printing apparatus according to any one of claim 1, claim 2 and claim 3, wherein said roller is formed with an elastic body.

5. A screen printing apparatus according to any one of claim 1, claim 2 and claim 3, further comprising a sponge member soaking a solvent; and a solvent storing tank for supplying solvent to the sponge member.

6. A screen printing apparatus according to claim 1, which further comprises a member having a pallet-shape which moves in contact with the lower surface of the mask, the member being moved together with the roller; a paste residue intake port capable of being moved together with the member, the paste residue intake port being positioned to maintain a gap with the lower surface of the mask, an air flow path being formed between the lower surface of the mask and an edge surface of said paste residue intake port; and a suction nozzle movable together with the member.

7. A screen printing apparatus according to claim 1, wherein said cleaning paper vibrating means includes means for vibrating said roller in a direction transverse to the moving direction of said roller by said roller moving means so that said cleaning paper vibrates together with the vibration of said roller.

8. A screen printing apparatus according to claim 1, wherein said cleaning paper vibrating means vibrates said cleaning paper independently of movement of said roller.

9. A screen printing apparatus according to claim 8, wherein said cleaning paper vibrating means vibrates said cleaning paper in a direction transverse to the moving direction of said roller.

10. A screen printing apparatus comprising:

a mask having pattern openings;

a squeegee for forming a pattern on a substrate, the squeegee being slid on an upper surface of said mask to print the pattern by forcing paste supplied on the upper surface of said mask onto the substrate placed under a lower surface of said mask through the pattern openings;

cleaning paper to be brought into contact with the lower surface of said mask;

a roller pressed against the lower surface of said mask with said cleaning paper interposed therebetween;

roller moving means for moving said roller in a desired direction with respect to the lower surface of said mask; and cleaning paper vibrating means for vibrating said cleaning paper in a plane substantially parallel to a plane of the lower surface of said mask;

wherein said cleaning paper vibrating means includes means for moving said cleaning paper with respect to said roller.

11. A screen printing apparatus according to any one of claim 1, claim 2, claim 3, claim 6, claim 10, claim 7 or claim 8, further comprising control means for adjusting any one of a speed of movement of said roller by said roller moving means, a speed of vibration of said cleaning paper and a movement speed of said cleaning paper.

* * * * *